US007267298B2

(12) United States Patent
Leininger

(10) Patent No.: US 7,267,298 B2
(45) Date of Patent: Sep. 11, 2007

(54) METHOD FOR CORRECTING THE FLIGHT PATH OF BALLISTICALLY FIRED SPIN-STABILISED ARTILLERY AMMUNITION

(75) Inventor: Jürgen Leininger, Hersbruck (DE)

(73) Assignee: Diehl Munitionssysteme GmbH & Co. KG, Röthenbach (DE)

( * ) Notice: Subject to any disclaimer, the term of this patent is extended or adjusted under 35 U.S.C. 154(b) by 356 days.

(21) Appl. No.: 10/484,486

(22) PCT Filed: Jul. 11, 2002

(86) PCT No.: PCT/EP02/07730

§ 371 (c)(1),
(2), (4) Date: Aug. 20, 2004

(87) PCT Pub. No.: WO03/008897

PCT Pub. Date: Jan. 30, 2003

(65) Prior Publication Data

US 2004/0262448 A1 Dec. 30, 2004

(30) Foreign Application Priority Data

Jul. 17, 2001 (DE) ..... 101 34 785

(51) Int. Cl.
*F42B 10/04* (2006.01)

(52) U.S. Cl. ..... 244/3.24; 102/490

(58) Field of Classification Search ..... 244/3.24, 244/3.29; 102/400, 490
See application file for complete search history.

(56) References Cited

U.S. PATENT DOCUMENTS 4,438,893 A * 3/1984 Sands et al. ..... 244/3.21
4,964,593 A * 10/1990 Kranz ..... 244/3.24
5,322,243 A * 6/1994 Stoy ..... 244/45 A
5,393,012 A * 2/1995 Dunn ..... 244/3.23
5,467,940 A 11/1995 Steuer

FOREIGN PATENT DOCUMENTS

DE 43 25 218 C2 7/1993
DE 198 45 611 A1 10/1998

* cited by examiner

*Primary Examiner*—Rob Swiatek
(74) *Attorney, Agent, or Firm*—Scully, Scott, Murphy & Presser, P.C.

(57) ABSTRACT

At very low apparatus expenditure, namely with a canard system which is adjustable in a single-axis mode, it is possible to achieve a spatially two-dimensional trajectory correction in respect of the artillery ammunition which in itself is unguided, with the additional degree of freedom in respect of trajectory extension and thus an extraordinary increase in the precision of delivery in relation to the predetermined target point.

6 Claims, 1 Drawing Sheet

METHOD FOR CORRECTING THE FLIGHT PATH OF BALLISTICALLY FIRED SPIN-STABILISED ARTILLERY AMMUNITION

BACKGROUND OF THE INVENTION

1. Field of Invention

The invention concerns a method of trajectory correction, which is effected in dependence on the instantaneous roll position in space, in respect of ballistically launched spin-stabilised artillery ammunition by means of canard surfaces, which are oriented radially in a single-axis configuration at the fuse tip, which is tapered in relation to the ammunition body thereof and which is roll decoupled.

2. Discussion of the Prior Art

A method of this type is known from DE 198 45 611 A1. There, the fuse tip which can be screwed on to the ammunition body has a component which, for spin reduction purposes, is rotatable with respect to the spin-stabilised ammunition body and from which two braking surfaces which are held rigidly at the same angle of incidence can be extended in the manner of canard wings transversely with respect to the spin axis in order to exert a directed braking action on the current trajectory of the ammunition in order to increase the level of target accuracy of the predetermined hitting point, depending on the respective instantaneous roll position in space. For the same purpose, by means of such a reduction in trajectory, by an increase in the braking action, it was already known from WO 98/01719 for two discs without incidence to be extended in diametrally mutually opposite relationship radially out of the ogive of a projectile.

It will be appreciated however that the installation space available in the projectile tip is required for the major part for the safety and fuse devices, and the additional installation of a receiver circuit for for example radar distance measurement or satellite navigation also already gives rise to serious difficulties. Therefore the necessary installation space for braking surfaces which are to be retracted here and for the mechanisms for moving and holding same in opposition to the dynamic loading produced by the afflux flow pressure is scarcely adequately available. Moreover, a point of fundamental disadvantage in regard to those previously known structures is that the directionally selective braking measure means that the trajectory can only be shortened and that therefore the degree of scatter in terms of target hit plotting can only be narrowed in one direction.

SUMMARY OF THE INVENTION

In consideration of those aspects the object of the present invention is to make the error disposition of ammunition ballistically fired over a target area overall more advantageous.

In accordance with the invention that object is attained in that, in accordance with the essential features of the combination as recited in the main claim and in accordance with the modifications and developments characterised in the appendant claims, the longitudinal and transverse scatter effects are now no longer compensated only in the direction of shorter ranges but, besides the directed reduction, a deliberate increase in the current trajectory is now is now also made possible.

BRIEF DESCRIPTION OF THE DRAWINGS

Reference may now be made to the following detailed description, taken in conjunction with the accompanying drawings; in which.

DETAILED DESCRIPTION OF THE INVENTION

Figure 1:
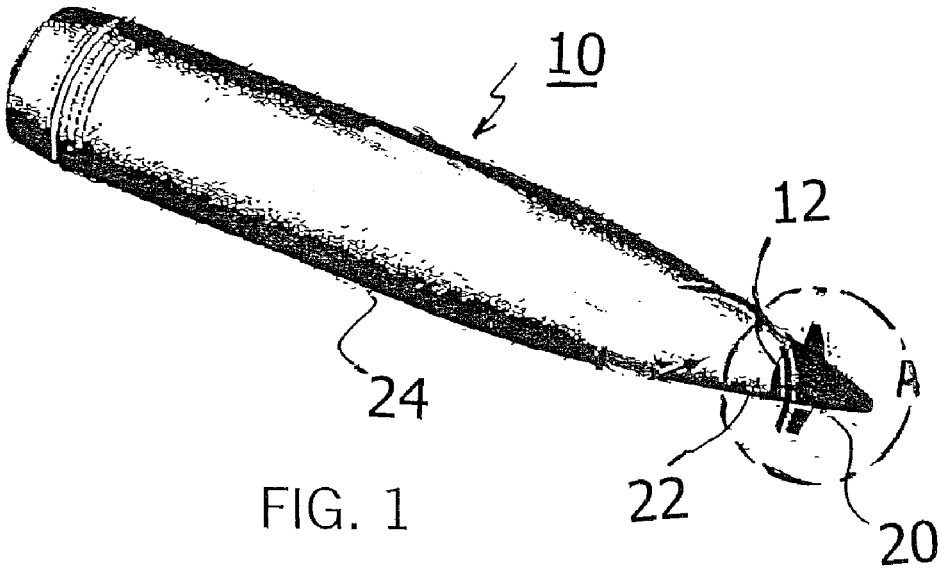
FIG. 1 illustrates a perspective view of an article of artillery ammunition pursuant to the invention.
Figure 2:
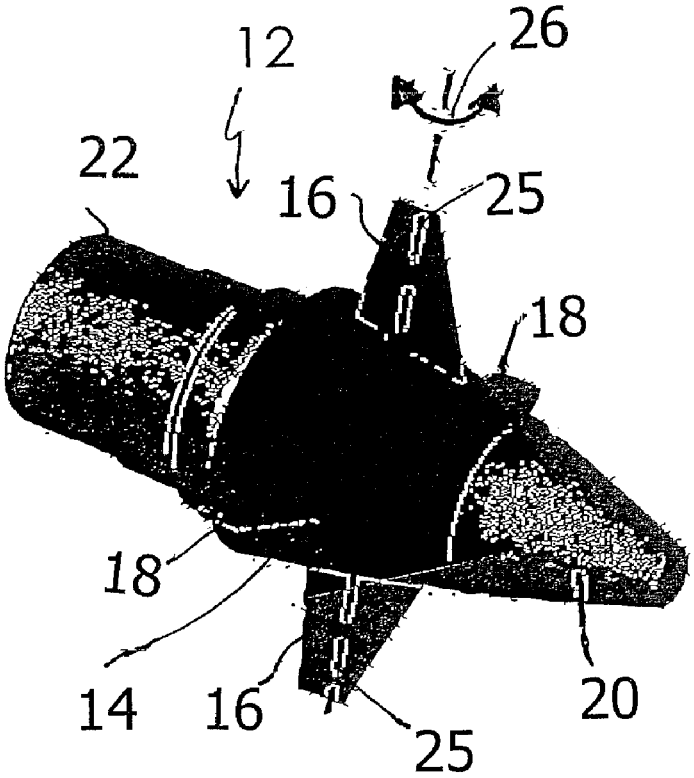
FIG. 2 ilustrates, on an enlarged scale, the top portion of the article of artillery ammunition, as shown in the encircled portion "A" of FIG. 1.

Refering now to FIG. 1, there is shown a spin-stabilized artillery pojectile 10 having an essentially cylindrical body 24. Mounted at the ogive end is a roll joint assembly 12, as illustrated in the encircled portion "A", as represented on an enlarged scale in FIG. 2.

The roll joint assembly 12 facilitates a rotational uncoupling between the essentially slower rotating projectile fuze tip portion 20 and the more rapidly rotating or spinning projectile body 24. Hereby, the roll assambly 12 incorporates a sleedve member 14 having a pair of canard wing surfaces 16, which are each pivotable about radial control shafts 25 along the directions of the double-headed arrow 26.

Further canard surfaces 18 may be mounted on the projectile body structure. Moreover, the end strucure 22 of the arrangement 12 is insertable in the body 24 of the projectile 10.

For that purpose, mounted laterally at the tapered front part of the ammunition, more specifically in the fuse which is decoupled in respect of rolling from the body of the ammunition, at the tip of the ogive, by means of control shafts which are oriented radially with respect to the spin axis, in radially mutually opposite relationship, are two identical-calibre canard wing surfaces which cannot be retracted but which can be set in a condition of incidence thereof with respect to the neutral position by rotation about their control shafts in both directions and with which, depending on the respective instantaneous position in space, it is possible deliberately to produce a pitching movement for influencing longitudinal scatter or a yawing movement for influencing transverse scatter. The pitching or yawing incidence adjustment which is in phase-correct relationship in relation to the instantaneous roll position in space is effected under the management of a roll position sensor in the fuse tip, which specifies how the control shafts of the two canard surfaces are oriented at that time in relation to the horizon of the Earth and in which direction in space therefore the trajectory is lengthened or reduced by a current incidence setting of the canard surfaces.

To provide for such controlled incidence setting of the canard surfaces, because of the small amount of installation space, the self-locking action of a strong transmission step-down arrangement and its low-cost availability, the preference is for a high-speed low-voltage dc motor, preferably in the coaxial configuration of a shaft transmission motor unit. In that case it is possible to provide a rotationally rigid coupling between the two control shafts in order to manage with a single drive system; or the two canard surfaces can be adjustable independently of each other by their own respective drives and then if necessary can also be adjusted in opposition directions, in the interests of highly dynamic control.

The expenditure in terms of electrical circuitry can be still further reduced if, instead of continuous incidence control, for alternately adjusting the canard surfaces, for that purpose the procedure involves using a three-point control system which is only ever deliberately temporarily switched in the active condition, for the duration of a maximum of a quarter of a revolution of the ammunition body about its spin axis in each case, or indeed it uses a two-point control system which always switches over in correct relationship with the roll phase.

The electrical power for incidence control can be afforded by batteries or still better can be produced by generator means in the fuse tip itself, namely making use of the relative movement between the ammunition body which is stabilised by faster rolling motion and the rotary speed, which is reduced in relation thereto, of the fuse tip which is decoupled in respect of rotation from the ammunition body by way of a rotary bearing.

For the purposes of determining the position of the fuse tip in space, the preference is for a magnetic sensor which responds to the magnetic field of the Earth, because in comparison with optronic horizon sensors it is all-weather-serviceable and in comparison with inertial platforms is less expensive and more compact.

Thus, at very low apparatus expenditure, namely with a canard system which is adjustable in a single-axis mode, as a consequence of the additional degree of freedom in respect of trajectory extension, it is possible to achieve a spatial trajectory correction in respect of the artillery ammunition which in itself is unguided, and thus an extraordinary increase in the precision of delivery in relation to the predetermined target point.

The invention claimed is:

1. A ballistically fireable spin-stabilized artillery ammunition article, which in plotted hits thereof evinces a longitudinal and transverse scattering;

a fuze which is roll-decoupled from a body of the ammunition at a tapered front part of the ammunition body; and two control shafts on said front part of the ammunition body oriented radially of a spin axis mounting two canard surfaces, which are directed oppositely away from said spin axis and which are adjustable about a single axis, said canard surfaces being of full caliber and non-retractable and responsive to rotation of their control shafts and being adjustable in both directions relative to a neutral setting, so as to be in accordance with a momentary roll position of the canard surfaces in space and in accordance with the actual setting of the surfaces through a controlled pitch movement, to influence the longitudinal scattering or through a controlled yaw movement influence the transverse scattering.

2. An artillery ammunition article as claimed in claim 1, wherein for the rotation of the control shafts implementing the settings of the canard surfaces there are provided high-speed low-voltage direct current motors with self-locking intense drive reductions forming a driving system.

3. An artillery ammunition article as claimed in claim 2, wherein said two control shafts are settable in opposing orientations.

4. An artillery ammunition article as claimed in claim 2, wherein said two control shafts are connected with each other secured against relative rotation, and are coupled to a single drive system.

5. An artillery ammunition article as claimed in claim 2, wherein there is provided a discontinuous control over the setting of the canard surfaces through respectively a maximum quarter-rotation of the ammunition body.

6. An artillery ammunition article as claimed in claim 2, wherein through the utilization of a relative movement between a rapidly rotating ammunition body and a contrastingly reduced rotational speed of the fuze tip which is rotationally-decoupled from the ammunition body, there is obtained a generated energy production for actuating the settings of the canard surfaces.

* * * * *